US008959706B2

(12) United States Patent
Park et al.

(10) Patent No.: US 8,959,706 B2
(45) Date of Patent: Feb. 24, 2015

(54) VACUUM CLEANER

(75) Inventors: Seong-Ho Park, Changwon-si (KR); Hae-Seock Yang, Changwon-si (KR); Young-Min Hyun, Changwon-si (KR); Hyuk-Joo Kwon, Changwon-si (KR); Hyo-Churl Shin, Changwon-si (KR); Sang-Jun Park, Changwon-si (KR); Jin-Wook Seo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 718 days.

(21) Appl. No.: 13/120,672

(22) PCT Filed: Feb. 12, 2009

(86) PCT No.: PCT/KR2009/000687

§ 371 (c)(1),
(2), (4) Date: Mar. 24, 2011

(87) PCT Pub. No.: WO2010/041799

PCT Pub. Date: Apr. 15, 2010

(65) Prior Publication Data

US 2011/0173771 A1 Jul. 21, 2011

(30) Foreign Application Priority Data

Oct. 9, 2008 (KR) ..... 10-2008-0098997

(51) Int. Cl.

| | |
|---|---|
| ***A47L 5/00*** | (2006.01) |
| ***A47L 9/00*** | (2006.01) |
| ***A47L 5/32*** | (2006.01) |
| ***A47L 5/22*** | (2006.01) |
| ***A47L 5/28*** | (2006.01) |

(52) U.S. Cl.

CPC . *A47L 5/32* (2013.01); *A47L 5/225* (2013.01); *A47L 5/28* (2013.01); *A47L 9/0045* (2013.01); *A47L 9/009* (2013.01)

USPC ..... 15/337; 15/328; 15/331; 15/334; 15/335; 15/323; 15/327.1

(58) Field of Classification Search

USPC ..... 15/334, 337, 323, 327.1, 328, 331, 335

See application file for complete search history.

(56) References Cited

U.S. PATENT DOCUMENTS

| | | | | |
|---|---|---|---|---|
| 2006/0143852 | A1 * | 7/2006 | Lee et al. | 15/334 |
| 2006/0230572 | A1 * | 10/2006 | Lee et al. | 15/334 |
| 2009/0089961 | A1 * | 4/2009 | Kim et al. | 15/335 |

FOREIGN PATENT DOCUMENTS

| | | | |
|---|---|---|---|
| JP | 04-058921 | | 2/1992 |
| KR | 10-0400567 | B1 | 10/2003 |
| KR | 10-0476168 | B1 | 3/2005 |
| KR | 10-0579518 | | 5/2006 |
| KR | 10-2008-066290 | | 7/2008 |
| KR | 1020090036069 | * | 4/2009 |

OTHER PUBLICATIONS

International Search Report issued in PCT/KR2009/000687 dated Nov. 3, 2009.

* cited by examiner

*Primary Examiner* — Bryan R Muller

(74) *Attorney, Agent, or Firm* — Ked & Associates, LLP

(57) ABSTRACT

A vacuum cleaner is provided. The vacuum cleaner includes a first suction unit, a main body, a second suction unit, a connection flow-tube, and a flow-passage switching device. The main body communicates with the first suction unit and includes a suction motor to generate a suction force. The second suction unit is configured to be selectively attached to the main body. The connection flow-tube is configured to selectively connect the first suction unit or the second suction unit to the suction motor. The flow-passage switching device is configured to connect the connection flow-tube to the first section unit or the second suction unit according to a disposition state of the second suction unit.

9 Claims, 14 Drawing Sheets

VACUUM CLEANER

BACKGROUND

The present disclosure relates to a vacuum cleaner.

Generally, vacuum cleaners are devices configured to suck air containing dust by using a suction force generated by a suction motor installed in a main body and then to filter the air in the main body to remove dust from the air.

Vacuum cleaners can be classified into: canister type vacuum cleaners in which a suction nozzle for sucking dust from a floor is connected to a main body through a connection device; and upright type vacuum cleaners in which a suction nozzle and a main body are formed in one piece.

Such an upright type vacuum cleaner includes: a suction nozzle used to suction dust and air while moving the suction nozzle along a floor; a main body rotatably coupled to the suction nozzle and including a suction motor; a handle disposed at an upper side of the main body so that a user can hold the handle during cleaning; and a dust collector disposed at the main body.

Wheels are provided on the suction nozzle so that the main body can be easily carried. A manipulation unit is provided at the rear side of the suction nozzle so that the main body can be rotated relative to the suction nozzle.

An operation of the vacuum cleaner will now be briefly described.

To perform a cleaning operation, the main body is inclined at a predetermined angle with respect to the suction nozzle.

Then, if the vacuum cleaner is turned on, a suction force is generated by the suction motor of the main body. Then, dust and air are sucked through the suction nozzle, and the sucked dust and air are guided to the dust collector.

The dust is removed from the air and is stored in the dust collector, and then the air is guided from the dust collector to the main body where the air is discharged through a side of the main body.

However, in the case of such a vacuum cleaner, since a cleaning operation is performed while moving a suction nozzle along a floor, it is difficult to clean places such as stairs and higher surfaces although a floor may be easily cleaned by using the vacuum cleaner.

Therefore, there is a need for a vacuum cleaner that can be used to clean various places as well as floors.

SUMMARY

Embodiments provide a vacuum cleaner that can be used to smoothly clean various places as well as floors.

Embodiments also provide a vacuum cleaner in which a suction flow-passage of a first suction unit is connected to a suction motor when cleaning a floor and a suction flow-passage of a second suction unit is connected to the suction motor when another place is cleaned.

In one embodiment, a vacuum cleaner includes: a first suction unit; a main body communicated with the first suction unit and including a suction motor to generate a suction force; a second suction unit configured to be selectively attached to the main body; a connection flow-tube configured to selectively connect the first suction unit or the second suction unit to the suction motor; and a flow-passage switching device configured to connect the connection flow-tube to the first section unit or the second suction unit according to a disposition state of the second suction unit.

In another embodiment, a vacuum cleaner includes: a main body including a suction motor to generate a suction force; a first suction unit rotatably connected to the main body; a second suction unit detachably coupled to the main body; a connection flow-tube communicated with the suction motor and communicated selectively with the first suction unit or the second suction unit; and a flow-passage switching device configured to move the connection flow-tube, wherein when the second suction unit is disposed on the main body, the connection flow-tube communicates with the first suction unit, and when the second suction unit is detached from the main body, the connection flow-tube communicates with the second suction unit.

In further another embodiment, a vacuum cleaner includes: a main body including first and second suction flow-passages to suck dust and air; a connection flow-tube disposed at downstream sides of the first and second suction flow-passages based on a flow of air; a flow-passage switching unit communicated with the connection flow-tube and configured to define a guide flow-passage to guide a flow of air, the flow-passage switching unit communicating selectively with one of the first and second suction flow-passages; and a transmission unit configured to transmit an actuating force to the flow-passage switching unit.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
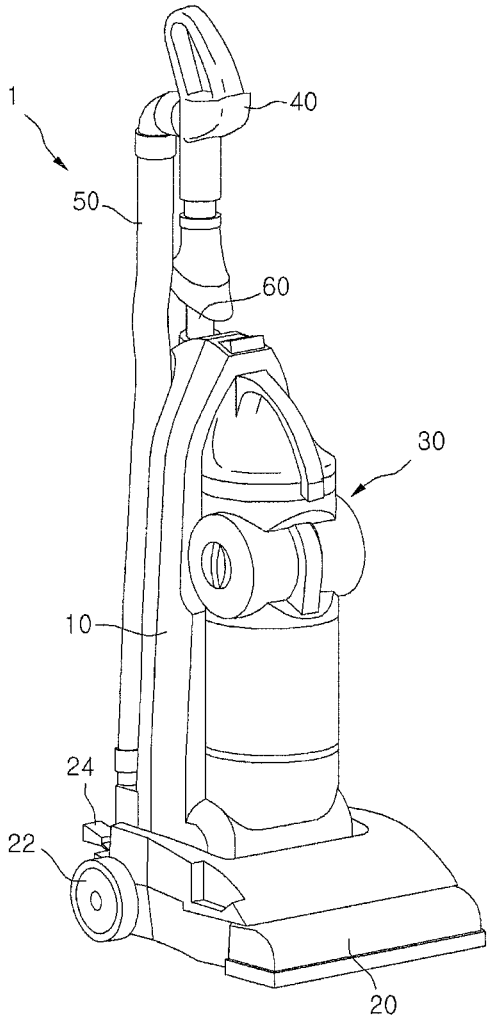
FIG. 1 is a front perspective view illustrating a vacuum cleaner according to a first embodiment.
Figure 2:
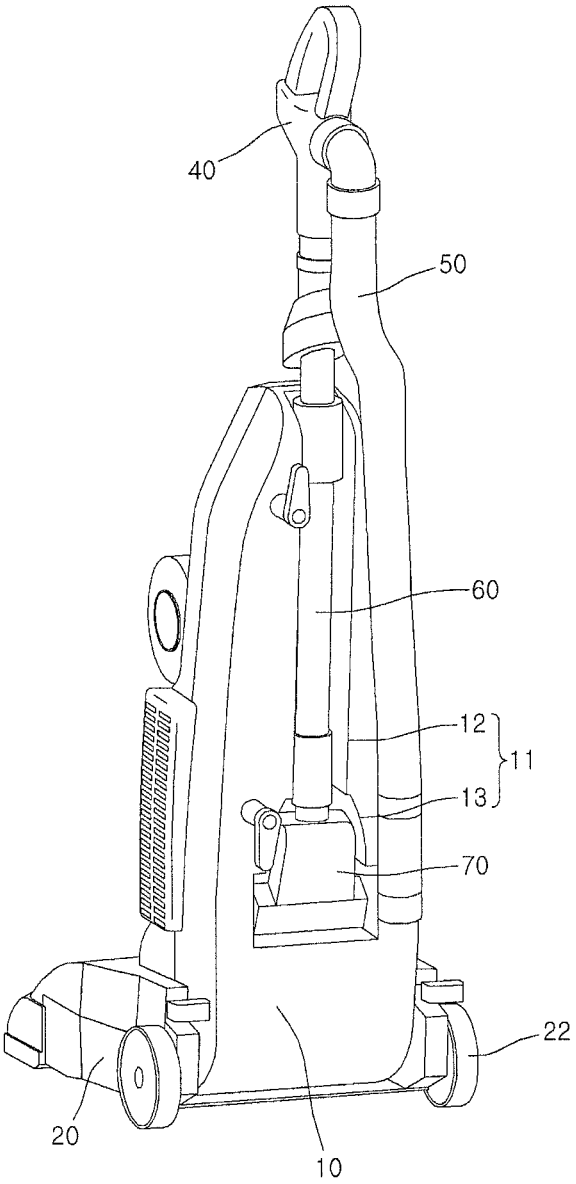
FIG. 2 is a rear perspective view illustrating the vacuum cleaner according to the first embodiment.
Figure 3:
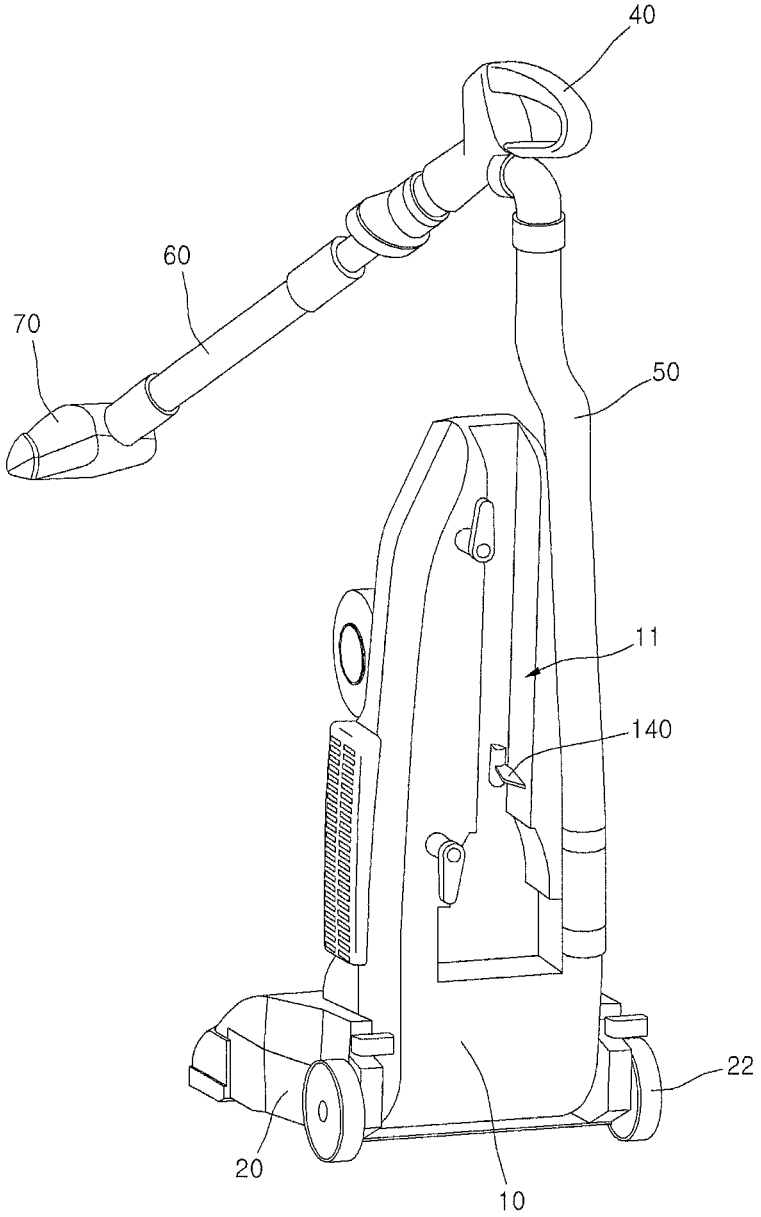
FIG. 3 is a rear perspective view illustrating a state where a second suction unit is detached from the vacuum cleaner.

FIG. 1 is a front perspective view illustrating a vacuum cleaner 1 according to a first embodiment, FIG. 2 is a rear perspective view illustrating the vacuum cleaner 1 according to the first embodiment, and FIG. 3 is a rear perspective view illustrating a state where a second suction unit is detached from the vacuum cleaner 1.

In the current embodiment, an upright type vacuum cleaner is described as an example.

Referring to FIGS. 1 to 3, the vacuum cleaner 1 of the current embodiment includes: a main body 10 in which a suction motor 110 (refer to FIG. 4) is disposed to generate a suction force; a first suction unit 20 rotatably coupled to a lower side of the main body 10 and configured to be placed on a floor; a dust collector 30 detachably disposed on the main body 10; the second suction unit detachably disposed on the main body 10 and configured to clean a floor or other places; a handle 40 disposed at an upper side of the main body 10; and a connection hose 50 connecting the handle 40 to the main body 10.

In detail, a suction inlet (not shown) is formed in the bottom side of the first suction unit 20 to suck dust and air from a floor. Wheels 22 are provided at both sides of the first suction unit 20 so that the first suction unit 20 can be easily moved.

Manipulation parts 24 are provided at the rear side of the first suction unit 20 so that the main body 10 can be rotated relative to the first suction unit 20 in a state where the main body 10 is erected.

That is, the main body 10 can be rotated relative to the first suction unit 20 by using the manipulation parts 24. Thus, a user can easily clean a floor while carrying the first suction unit 20 by holding the handle 40.

The dust collector 30 is selectively disposed on the front side of the main body 10, and the second suction unit is selectively disposed on the rear side of the main body 10.

The dust collector 30 separate dust from air sucked into the main body 10 and stores the separated dust.

The second suction unit includes a nozzle 70 used to clean a floor or other places and a suction tube 60 connecting the nozzle 70 to the handle 40.

A concave mounting portion 11 is formed in the rear surface of the main body 10 to dispose the second suction unit on the rear surface of the main body 10.

The mounting portion 11 includes a suction tube mounting portion 12 for the suction tube 60 and a nozzle mounting portion 13 for the nozzle 70. In the current embodiment, since the nozzle 70 can be disposed in the main body 10, it is unnecessary to additionally store the nozzle 70.

In addition, since the nozzle 70 is disposed in the main body 10 in a state where the nozzle 70 is coupled to the suction tube 60, it is unnecessary to couple the nozzle 70 to the suction tube 60 each time the nozzle 70 is used.

A flow-passage (not shown) is formed in the handle 40 so that dust and air sucked through the nozzle 70 can flow through the handle 40. Dust and air sucked through the nozzle 70 are carried to the main body 10 through the connection hose 50.

The connection hose 50 may be formed of a flexible material in a manner such that the length of the connection hose 50 can be adjusted.

An operation of the vacuum cleaner 1 will now be briefly described according to the current embodiment.

In the case of an upright type vacuum cleaner of the related art, cleaning is performed while carrying a suction unit coupled to the bottom side of a main body along a floor. Therefore, it is difficult to clean other places than floors by using an upright type vacuum cleaner.

However, according to the current embodiment, the second suction unit is detachably disposed on the main body 10 so that other places than floors can be cleaned.

That is, after detaching the second suction unit from the main body 10, a floor or other places can be cleaned by using the second suction unit.

Specifically, in a floor cleaning operation, the second suction unit (60 and 70) is disposed on the main body 10 as shown in FIG. 1, and the main body 10 is allowed to be rotated relative to the first suction unit 20. Then, a user can clean a floor while carrying the first suction unit 20 along the floor.

On the other hand, in an operation for cleaning other places than floors, the main body 10 is erected, and the second suction unit (60 and 70) is detached from the main body 10 as shown in FIG. 1. Then, dust and air are sucked from a desired place by using the second suction unit (60 and 70).

As described above, to selectively perform cleaning operations by using the first suction unit 20 or the second suction unit, two flow-passages through which air can flow are formed in the main body 10. The two flow-passages are selectively connected to the suction motor 110.

Figure 4:
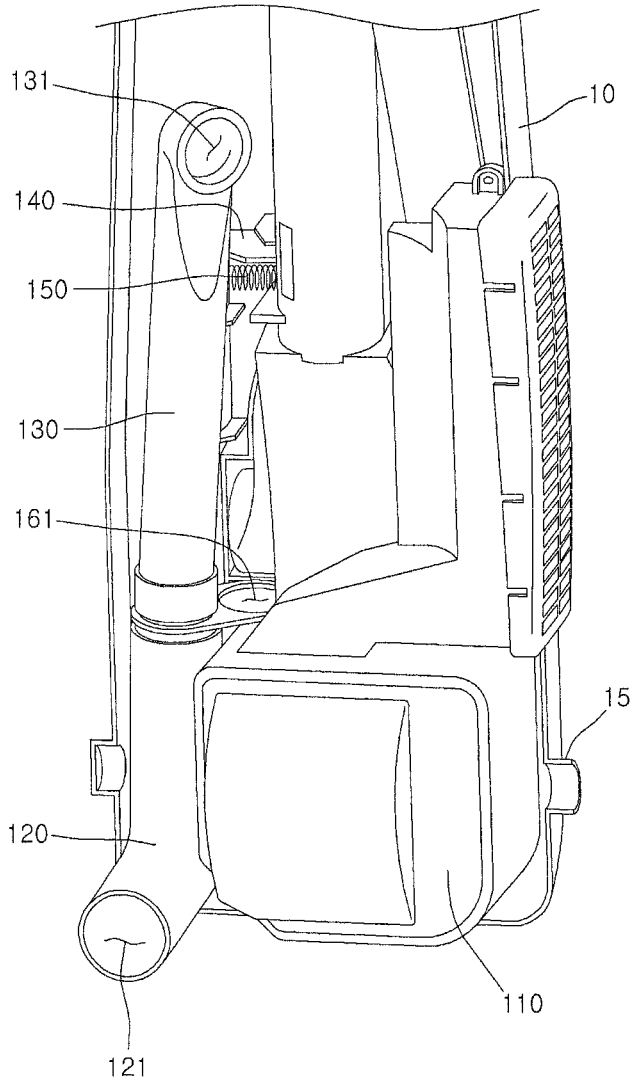
FIG. 4 is a perspective view illustrating flow-passages in a main body according to the first embodiment.

FIG. 4 is a perspective view illustrating flow-passages in the main body 10 according to the first embodiment.

Referring to FIGS. 3 and 4, the suction motor 110 is disposed in the main body 10 to generate a suction force. Rotation axles 15 are provided at both sides of the main body 10 so that the main body 10 can be rotated relative to the first suction unit 20.

The main body 10 includes: a first suction flow-tube 120 in which a first suction flow-passage 121 is formed to allow flows of air and dust sucked through the first suction unit 20; a second suction flow-tube 160 (refer to FIG. 5) in which a second suction flow-passage 161 is formed to allow flows of air and dust sucked through the second suction unit; a connection flow-tube 130 rotatably connected to the main body 10 and including a connection flow-passage 131 to allow flows of air and dust from the first suction flow-passage 121 or the second suction flow-passage 161 to the dust collector 30; a first member 140 allowing rotation of the connection flow-tube 130 when the second suction unit is disposed in the mounting portion 11, and a second member 150 making the connection flow-tube 130 return to its original position after being rotated.

In detail, the first member 140 is rotatably connected to an inner side of the main body 10, and a part of the first member 140 is inserted through the main body 10 so that the part is exposed at the mounting portion 11. An end of the second member 150 is connected to the connection flow-tube 130, and the other end of the second member 150 is connected to the inner side of the main body 10. For example, the second member 150 may be an elastic member.

When the second suction unit is disposed in the mounting portion 11, the first member 140 is rotated by the second suction unit. When the first member 140 is rotated, the connection flow-tube 130 is pushed by the first member 140, and thus the connection flow-tube 130 is rotated in a predetermined direction. Then, the connection flow-passage 131 is connected to the first suction flow-passage 121.

On the other hand, if the second suction unit is separated from the mounting portion 11, since the first member 140 does not receive a rotation force, the connection flow-tube 130 can be rotated in a direction opposite to the predetermined direction by the elasticity of the second member 150. Then, the connection flow-passage 131 is connected to the second suction flow-passage 161.

In the current embodiment, the connection flow-tube 130 is switched to one of the inner flow-passages of the main body 10 by the first member 140 and the second member 150. Thus, the first member 140 and the second member 150 may be referred to as a flow-passage switching device.

An operation of the vacuum cleaner 1 will now be described according to the current embodiment.

Figure 5:
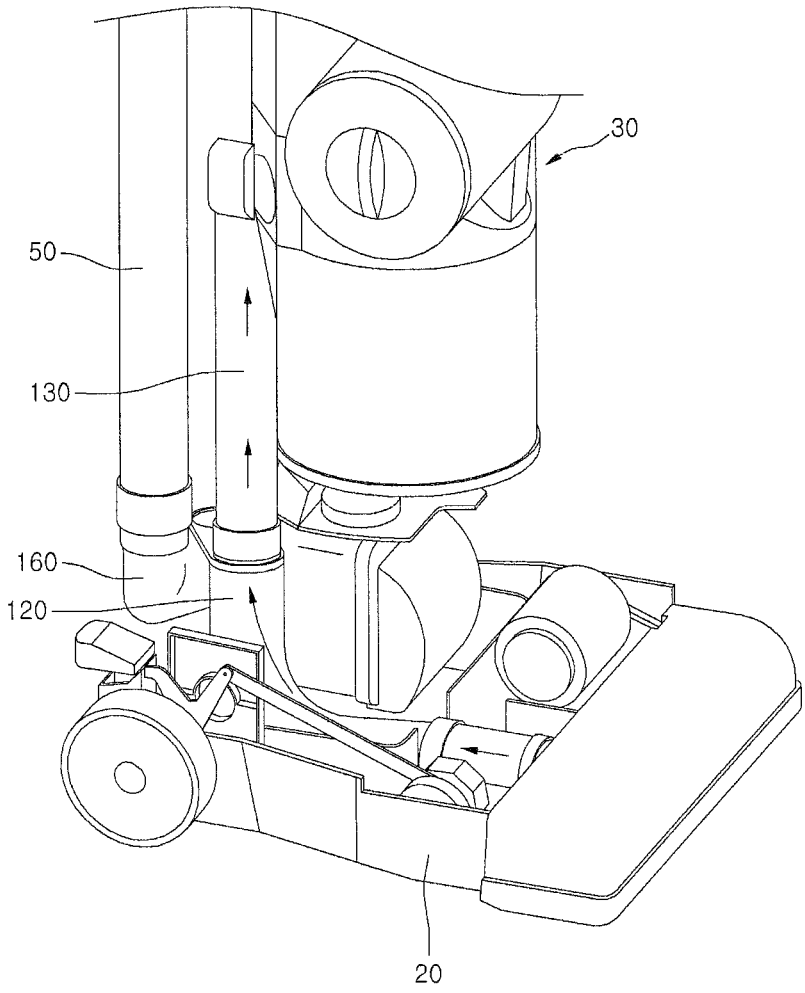
FIGS. 5 and 6 are views illustrating the flow-passages of the vacuum cleaner in a state where the second suction unit is disposed on the main body.
Figure 6:
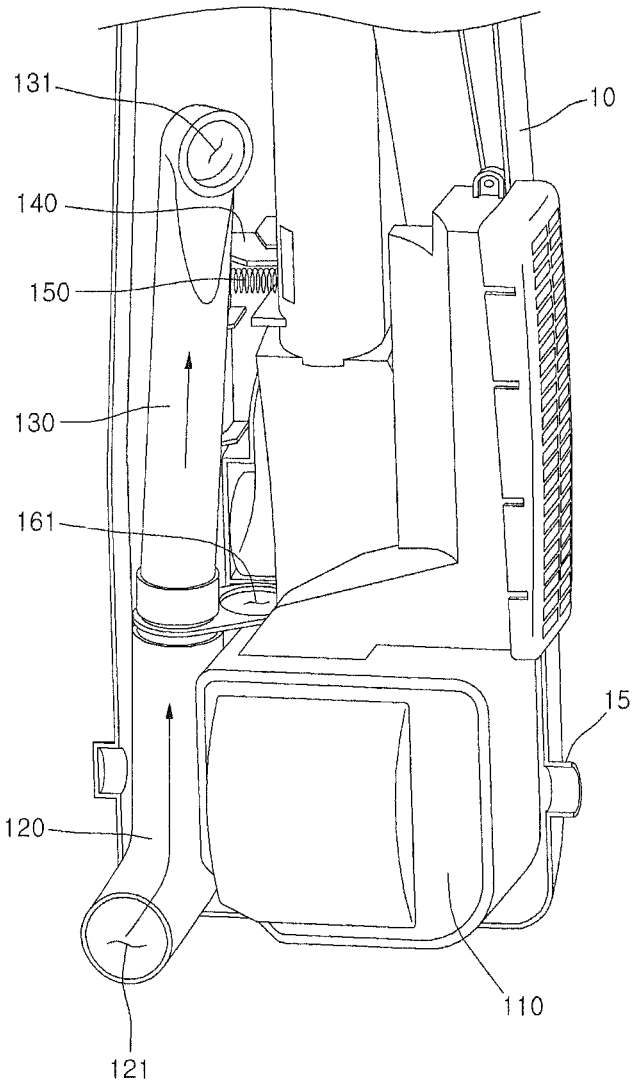

FIGS. 5 and 6 are views illustrating the flow-passages of the vacuum cleaner 1 in a state where the second suction unit is disposed on the main body 10.

Referring to FIGS. 5 and 6, a floor can be cleaned by using the first suction unit 20. The second suction unit is disposed on the main body 10. When the second suction unit is disposed on the mounting portion 11, the first member 140 is pushed and rotated by the second suction unit, and thus the connection flow-tube 130 is connected to the first suction flow-tube 120 by the rotation of the first member 140. Then, a suction force generated by the suction motor 110 is applied to the first suction flow-tube 120.

In this state, if the manipulation parts 24 are manipulated, the main body 10 can be rotated relative to the first suction unit 20.

Dust and air are sucked through the first suction unit 20 by the suction force generated by the suction motor 110. The dust and air flow to the dust collector 30 through the first suction flow-tube 120 and the connection flow-tube 130.

Figure 7:
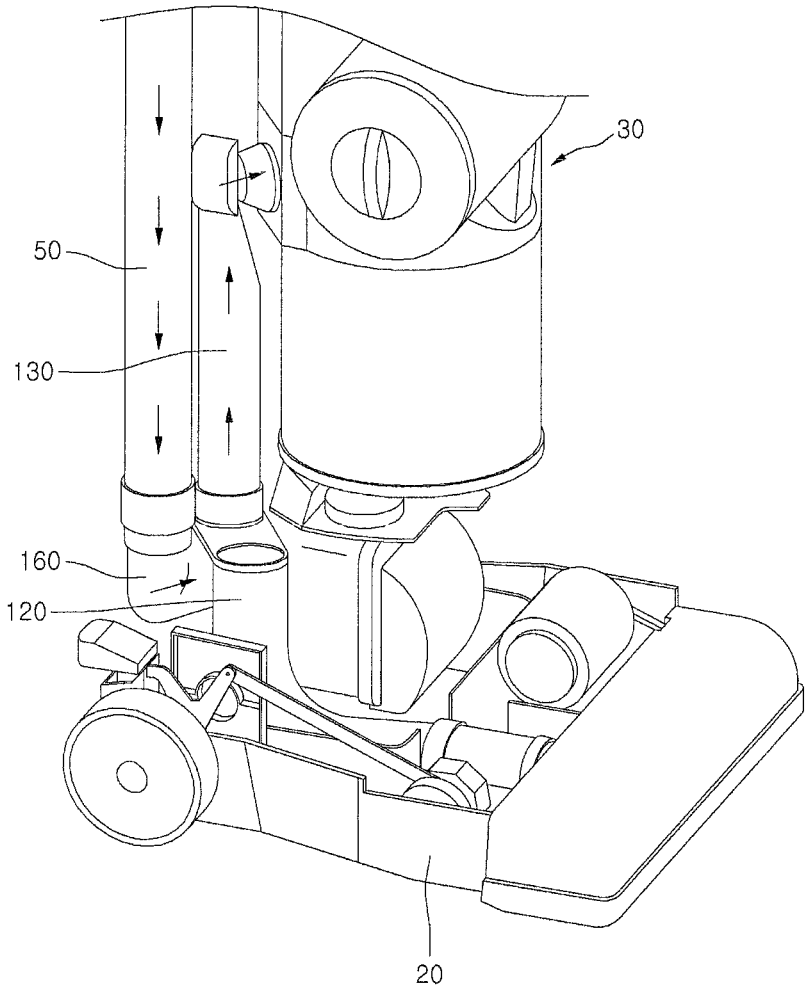
FIGS. 7 and 8 are views illustrating the flow-passages of the vacuum cleaner in a state where the second suction unit is detached from to the main body.
Figure 8:
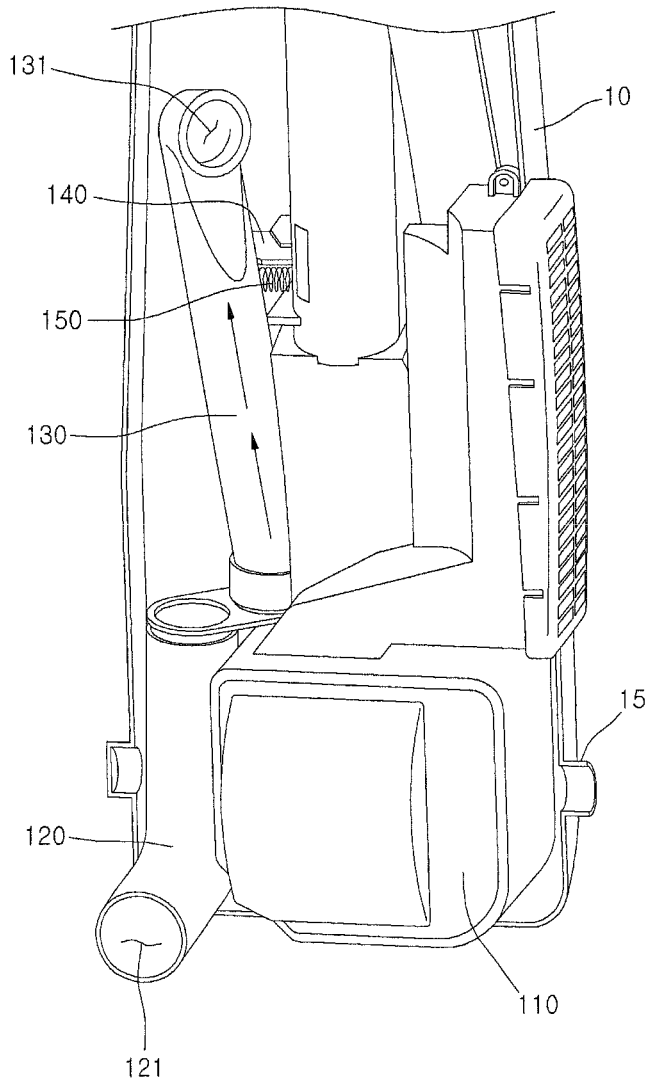

FIGS. 7 and 8 are views illustrating the flow-passages of the vacuum cleaner 1 in a state where the second suction unit is detached from to the main body 10.

Referring to FIGS. 7 and 8, if it is difficult to clean other places than a floor such as an under-furniture surface, stairs, and narrow gaps by using the first suction unit 20, the second suction unit can be used to clean such places. The second suction unit can also be used to clean a floor.

For using the second suction unit, first, the main body 10 is erected with respect to the first suction unit 20. In the current embodiment, the main body 10 may not be erected with reference to the first suction unit 20 for using the second suction unit. However, to stably perform a cleaning operation by using the second suction unit, the main body 10 may be erected with reference to the first suction unit 20.

Then, the second suction unit is detached from the main body 10. If the second suction unit is detached from the main body 10, the first member 140 does not receive a pressing force (rotational force) from the second suction unit. Thus, the connection flow-tube 130 is rotated by the elasticity of the second member 150 so that the connection flow-tube 130 can communicate with the second suction flow-tube 160.

Then, dust and air can be sucked through the nozzle 70 by a suction force generated by the suction motor 110. The dust and air flow to the dust collector 30 sequentially through the suction tube 60, the handle 40, the connection hose 50, the second suction flow-tube 160, and the connection flow-tube 130.

After finishing the cleaning operation by using the second suction unit, the second suction unit is disposed in the mounting portion 11. Then, the connection flow-tube 130 is rotated by the first member 140, and by this the connection flow-tube 130 is connected to the first suction flow-tube 120.

According to the above-described embodiment, the connection flow-tube 130 is automatically rotated and connected to one to the first suction flow-passage 121 and the second suction flow-passage 161 according to the disposition state of the second suction unit. Therefore, user's manipulation is unnecessary for switching the inner flow-passages of the main body 10.

Figure 9:
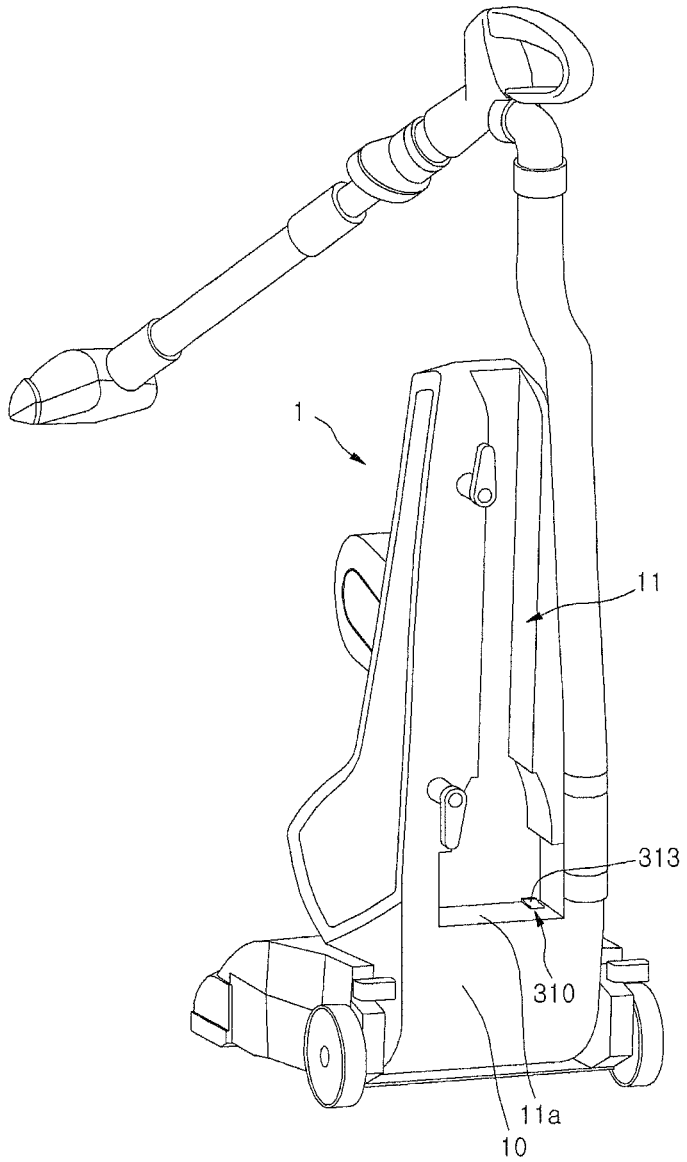
FIG. 9 is a rear perspective view illustrating a state where a second suction unit is detached from a vacuum cleaner according to a second embodiment.
Figure 10:
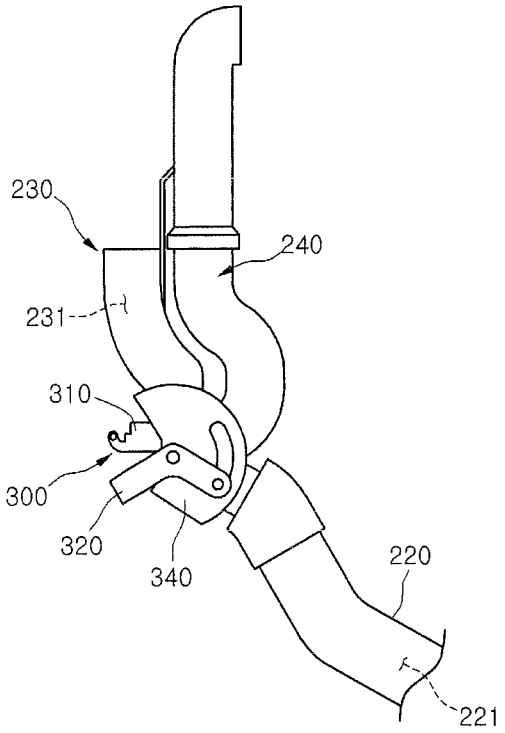
FIGS. 10 and 11 are schematic views illustrating flow-passages in a main body according to the second embodiment.
Figure 11:
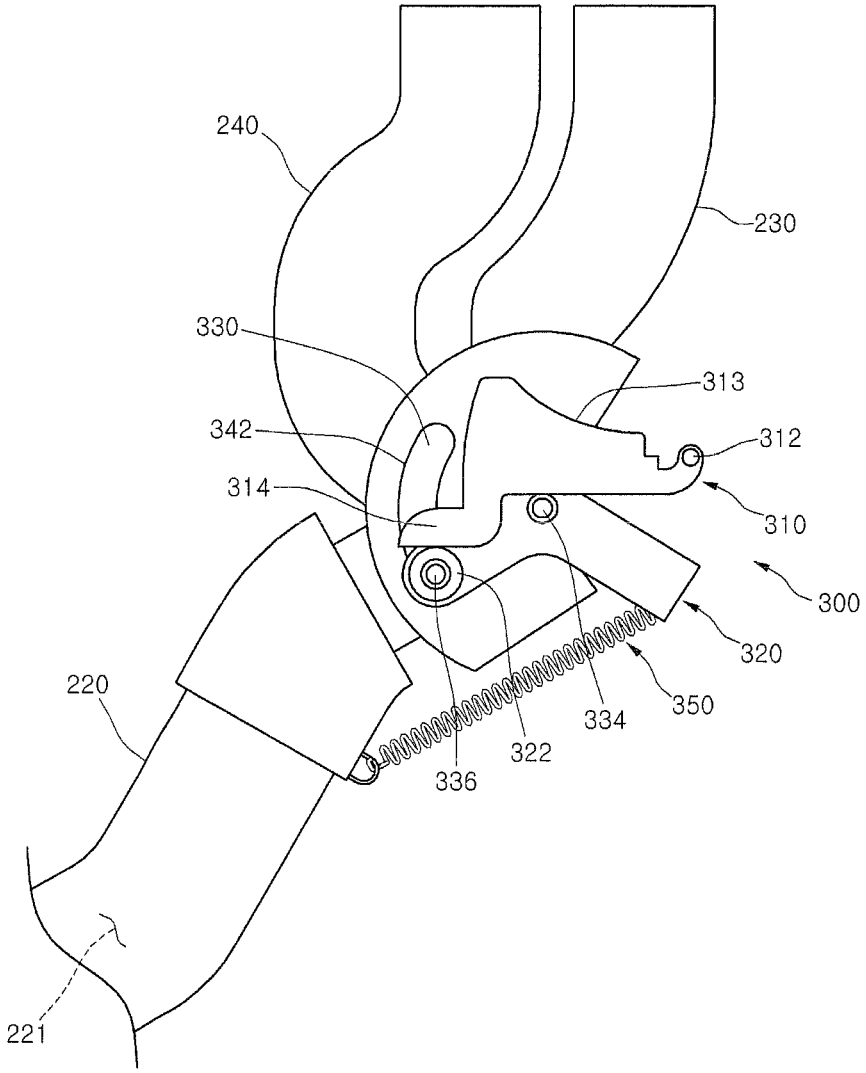
Figure 12:
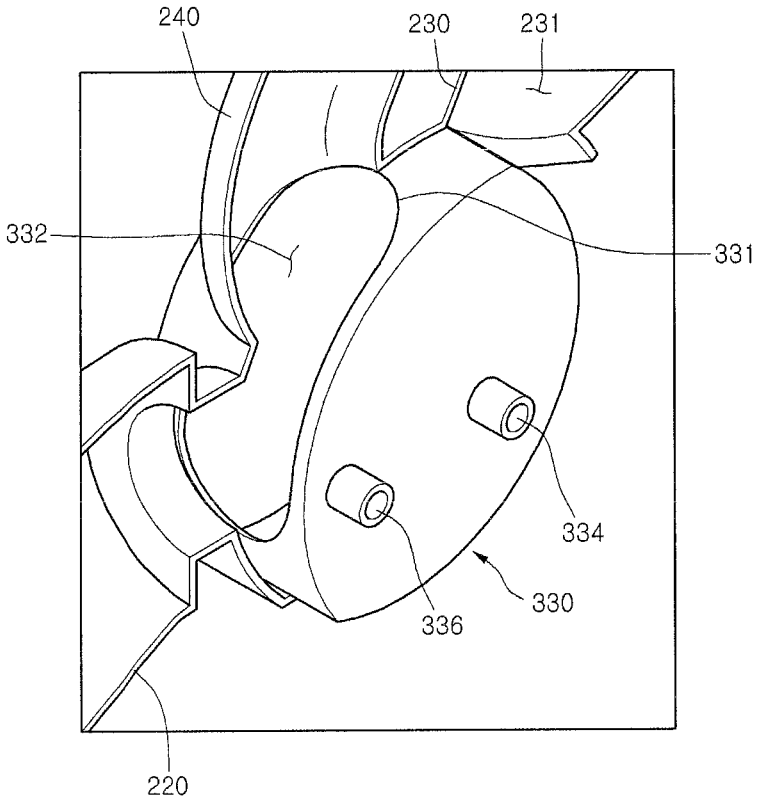
FIG. 12 is a view illustrating a flow-passage switching unit of a flow-passage switching device according to the second embodiment.

FIG. 9 is a rear perspective view illustrating a state where a second suction unit is detached from a vacuum cleaner 1 according to a second embodiment, FIGS. 10 and 11 are schematic views illustrating flow-passages in a main body 10 according to the second embodiment, and FIG. 12 is a view illustrating a flow-passage switching unit 330 of a flow-passage switching device 300 according to the second embodiment. FIGS. 11 and 12 are views illustrating the flow-passage switching device 300 in a state where the second suction unit is disposed on the main body 10.

The current embodiment is equal to the first embodiment except for the flow-passage switching device 300 and the flow-passages. Therefore, in the following description, characteristic elements of the current embodiment will be mainly described, and the same elements as those of the first embodiment will be denoted by the same reference numerals.

Referring to FIGS. 9 to 12, the main body 10 of the current embodiment includes: a first suction flow-tube 220 in which a first suction flow-passage 221 is formed to allow flows of air and dust sucked through a first suction unit 20; a second suction flow-tube 230 in which a second suction flow-passage 231 is formed to allow flows of air and dust sucked through the second suction unit; a connection flow-tube 240 rotatably connected to the main body 10 to allow flows of air and dust from the first suction flow-passage 221 or the second suction flow-passage 231 to a dust collector 30; and the flow-passage switching device 300 configured to operate according to the disposition state of the second suction unit so as to switch the flow-passages of the main body 10.

In detail, a part of the first suction flow-tube 220 is disposed at the first suction unit 20. The first suction flow-tube 220 communicates with a suction inlet of the first suction unit 20.

Based on an air flow, the connection flow-tube 240 is disposed at the downstream sides of the first suction flow-passage 221 and the second suction flow-passage 231 but at the upstream sides of a suction motor 110 and the dust collector 30.

The flow-passage switching device 300 includes: a first transmission member 310 configured to be selective moved by the second suction unit; a second transmission member 320 configured to be moved by the first transmission member 310; the flow-passage switching unit 330 configured to be moved by the second transmission member 320 so as to connect one of the first suction flow-passage 221 and the second suction flow-passage 231 to the connection flow-tube 240; and an elastic member 350 connected to the second transmission member 320. An actuating force (for example, a pressing force exerted by the second suction unit when the second suction unit is disposed or an elastic force exerted by the elastic member 350) is transmitted to the flow-passage switching unit 330 through the first transmission member 310 and the second transmission member 320. Therefore, the first transmission member 310 and the second transmission member 320 may be referred to as a transmission unit.

The first transmission member 310 is rotatably connected to an inner side of the main body 10 by using a hinge 312. A rest surface 313 is formed on the upper side of the first transmission member 310 so that a nozzle 70 can be selectively placed on the rest surface 313. When the nozzle 70 is not placed on the rest surface 313, the rest surface 313 is inserted through the main body 10 and exposed at a mounting portion 11. At this time, the rest surface 313 may be inserted through a bottom surface 11*a* of the mounting portion 11.

A contact part 314 is disposed on the bottom side of the first transmission member 310 for making contact with the second transmission member 320.

An opening 331 is formed in the flow-passage switching unit 330 to allow a flow of air. A guide flow-passage 332 is defined in the flow-passage switching unit 330 to guide flows of air. That is, air flows from the first suction flow-passage 221 or the second suction flow-passage 231 to the guide flow-passage 332, and then the air flows to the connection flow-tube 240.

The flow-passage switching unit 330 is rotatably coupled to a guide member 340 provided on the main body 10. The flow-passage switching unit 330 includes a rotation shaft 334 used as a rotation center, and a guide protrusion 336 used to guide rotation of the flow-passage switching unit 330. As the flow-passage switching unit 330 is rotated on the rotation shaft 334, the first suction flow-passage 221 or the second suction flow-passage 231 is connected to the connection flow-tube 240 by the flow-passage switching unit 330.

The guide member 340 includes a guide hole 342 to receive and guide the guide protrusion 336. The guide protrusion 336 is moved within the guide hole 342. That is, rotation of the flow-passage switching unit 330 is limited by the guide protrusion 336 and the guide hole 342.

The guide member 340 includes a shaft penetration hole (not shown) to receive the rotation shaft 334.

The second transmission member 320 is coupled to the guide protrusion 336 inserted through the guide hole 342 and the rotation shaft 334 inserted through the shaft penetration hole. The flow-passage switching unit 330 is rotated together with the second transmission member 320.

The second transmission member 320 includes a protrusion coupling part 322 for coupling with the guide protrusion 336. The contact part 314 makes contact with the protrusion coupling part 322.

An end of the elastic member 350 is fixed to the main body 10, and the other end of the second transmission member 320 is fixed to the second transmission member 320. If the nozzle 70 is positioned off the first transmission member 310, the first transmission member 310 is moved by the second transmission member 320 which receives a force from the elastic member 350 so that the first transmission member 310 can be exposed at the mounting portion 11.

An operation of the vacuum cleaner 1 will now be described according to the current embodiment.

Figure 13:
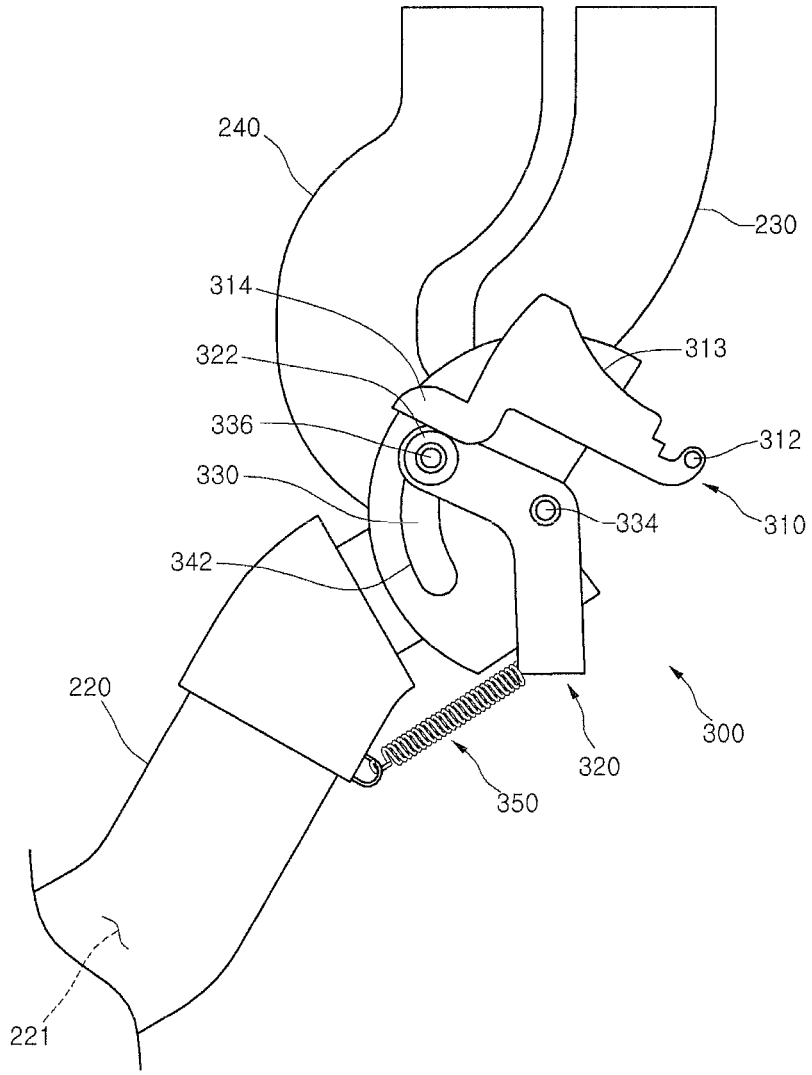
FIGS. 13 and 14 are views illustrating the structure of the flow-passage switching device in a state where the second suction unit is disposed on the main body.
Figure 14:
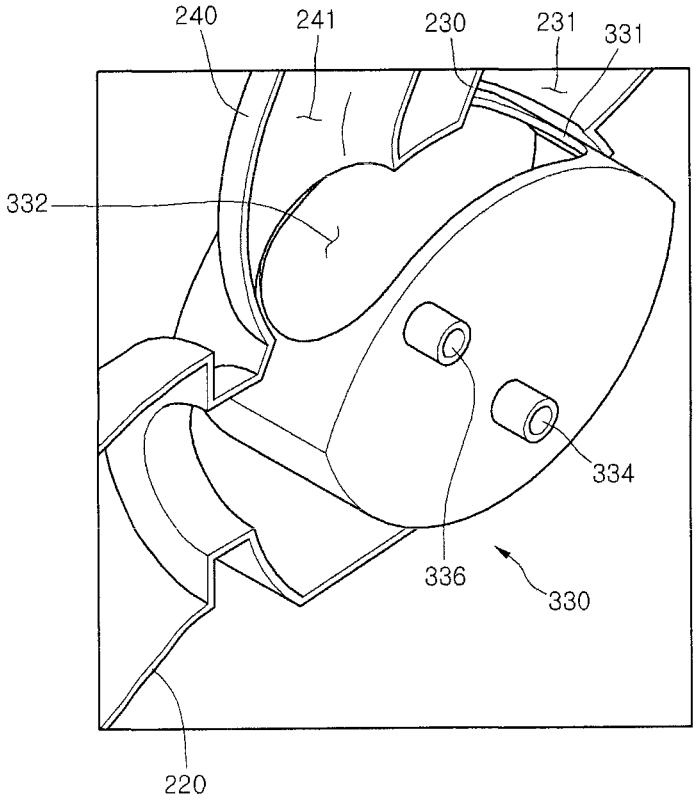

FIGS. 13 and 14 are views illustrating the structure of the flow-passage switching device 300 in a state where the second suction unit is disposed on the main body 10.

Referring to FIGS. 11 to 14, a floor can be cleaned by using the first suction unit 20. At this time, the second suction unit is disposed in the main body 10. In the state where the second suction unit is disposed in the mounting portion 11 of the main body 10, the second suction unit presses the first transmission member 310 so that the first transmission member 310 is rotated counterclockwise when viewed in FIG. 11. The rotation of the first transmission member 310 is transmitted to the second transmission member 320 so that the second transmission member 320 and the flow-passage switching unit 330 are rotated counterclockwise when viewed in FIG. 11. Then, the flow-passage switching unit 330 connects the first suction flow-tube 220 to the connection flow-tube 240. As a result, a suction force of the suction motor 110 is applied to the first suction flow-tube 120.

In this state, a user can manipulate manipulation parts 24 to rotate the main body 10 relative to the first suction unit 20.

Then, dust and air can be sucked through the first suction unit 20 by a suction force generated by the suction motor 110. The dust and air flow to the dust collector 30 through the first suction flow-tube 220, the guide flow-passage 332, and connection flow-tube 240.

If it is difficult to clean other places than a floor such as an under-furniture surface, stairs, and narrow gaps by using the first suction unit 20, the second suction unit can be used to clean such places. The second suction unit can also be used to clean a floor.

First, the main body 10 is erected with respect to the first suction unit 20 to clean other places than a floor. In the current embodiment, the main body 10 may not be erected with reference to the first suction unit 20 for using the second suction unit. However, to stably perform a cleaning operation by using the second suction unit, the main body 10 may be erected with reference to the first suction unit 20.

Then, the second suction unit is detached from the main body 10. If the second suction unit is detached from the main body 10, the first transmission member 310 does not receive a pressing force (rotational force) from the second suction unit. Then, the second transmission member 320 and the flow-passage switching unit 330 are rotated clockwise when viewed in FIG. 13, by the elasticity of the elastic member 350. Then, the second suction flow-tube 230 is connected to the connection flow-tube 240 by the flow-passage switching unit 330. As a result, a suction force of the suction motor 110 is applied to the second suction flow-tube 230. When the second transmission member 320 is rotated clockwise, the first transmission member 310 is also rotated clockwise so that a part (the rest surface 313) of the first transmission member 310 can be exposed at the mounting portion 11.

Then, dust and air can be sucked through the nozzle 70 by a suction force generated by the suction motor 110. The dust and air flow to the dust collector 30 sequentially through a suction tube 60, a handle 40, a connection hose 50, the second suction flow-tube 230, the guide flow-passage 332, and the connection flow-tube 240.

After finishing the cleaning operation by using the second suction unit, the second suction unit is disposed in the mounting portion 11. Then, the first transmission member 310 is rotated to rotate the second transmission member 320 and the flow-passage switching unit 330. As a result, the connection flow-tube 240 is connected to the first suction flow-tube 220.

As described above, according to the embodiments, the second suction unit can be detached from the main body to clean various places as well as floors.

In addition, since the second suction unit can be disposed on the main body, it is unnecessary to store the second suction unit in a separate place.

In addition, since the flow-passages of the main body are switched according to whether the second suction unit is disposed on the main body or not, additional manipulation is unnecessary to switch the flow-passages.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:

a first suction device;

a main body that communicates with the first suction device and comprising a suction motor to generate a suction force;

a second suction device configured to be selectively attached to the main body, the second suction device comprising a nozzle and a suction tube detachably connected to the nozzle to guide air and dust introduced by the nozzle to the main body;

a connection flow-tube configured to selectively connect the first suction device or the second suction device to the suction motor; and a flow-passage switching device configured to connect the connection flow-tube to the first suction device or the second suction device according to a disposition state of the second suction device, wherein the main body further comprises a nozzle mounting portion on which the nozzle is mounted and a suction tube mounting portion on which the suction tube is mounted, wherein the nozzle mounting portion is recessed in a rear wall of the main body toward a front of the main body, wherein the suction tube mounting portion is recessed in the rear wall of the main body toward the front of the main body, wherein the suction tube mounting portion is disposed above the nozzle mounting portion, wherein the flow-passage switching device comprises a first member configured to move the connection flow-tube in one direction to connect to the first suction device when the suction tube is mounted on the suction tube mounting portion, and wherein a portion of the first member protrudes from an interior of the main body, through the recessed rear wall of the main body and into the suction tube mounting portion.

2. The vacuum cleaner according to claim 1, wherein the connection flow-tube is rotatably coupled to an inner side of the main body.

3. The vacuum cleaner according to claim 2, wherein when the second suction device is disposed on the main body, the connection flow-tube is rotated in the one direction to connect to the first suction device, and wherein when the second suction device is detached from the main body, the connection flow-tube is rotated in the other direction and connected to the second suction device.

4. The vacuum cleaner according to claim 1, wherein the flow-passage switching device further comprises a second member configured to move the connection flow-tube in the other direction when the suction tube is detached from the suction tube mounting portion.

5. The vacuum cleaner according to claim 4, wherein when the second suction device is disposed on the main body, the flow-passage switching device connects the first suction device and the connection flow-tube, and wherein when the second suction device is detached from the main body, the flow-passage switching device connects the second suction device and the connection flow-tube.

6. The vacuum cleaner according to claim 4, wherein the first member is rotatably connected to the main body and configured to be rotated by the second suction device, and wherein an end of the second member is connected to the main body and the other end of the second member is connected to the connection flow-tube that forms a connection flow-passage.

7. The Vacuum cleaner according claim 1, further comprising at least one manipulation part provided at a rear side of the first suction device so that the main body is selectively rotated relative to the first suction device in a state where the main body is erected.

8. The vacuum cleaner according to claim 1, further comprising a dust collector configured to be selectively attached to the main body.

9. The vacuum cleaner according to claim 1, wherein the second suction device further comprises a handle connected to the suction tube and a connection hose to connect the handle to the main body.

* * * * *